US009121272B2

(12) United States Patent
Potapenko et al.

(10) Patent No.: US 9,121,272 B2
(45) **Date of Patent: *Sep. 1, 2015**

(54) METHOD OF FRACTURING MULTIPLE ZONES WITHIN A WELL

(75) Inventors: Dmitry Ivanovich Potapenko, Novosibirsk (RU); Bruno Lecerf, Novosibirsk (RU); Olga Petrovna Alekseenko, Novosibirsk (RU); Christopher N Fredd, Westfield, NY (US); Elena Nikolaevna Tarasova, Solnechny (RU); Oleg Medvedev, Kyiv (UA); Matthew Robert Gillard, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 821 days.

This patent is subject to a terminal disclaimer.

(21) Appl. No.: 13/204,392

(22) Filed: Aug. 5, 2011

(65) Prior Publication Data

US 2013/0032350 A1 Feb. 7, 2013

(51) Int. Cl.
*E21B 43/26* (2006.01)
*E21B 43/14* (2006.01)

(52) U.S. Cl.
CPC ..... *E21B 43/26* (2013.01); *E21B 43/14* (2013.01)

(58) Field of Classification Search
USPC ..... 166/280.1, 255.2, 271, 308.1, 250.1, 166/283
See application file for complete search history.

(56) References Cited

U.S. PATENT DOCUMENTS

| | | | | |
|---|---|---|---|---|
| 3,937,283 | A | 2/1976 | Blauer et al. | |
| 4,938,286 | A | 7/1990 | Jennings | |
| 4,974,675 | A * | 12/1990 | Austin et al. | 166/250.1 |
| 5,269,375 | A | 12/1993 | Schroeder, Jr. | |
| 5,287,924 | A | 2/1994 | Burleson et al. | |
| 5,295,393 | A | 3/1994 | Thiercelin | |

(Continued)

FOREIGN PATENT DOCUMENTS

WO 2009/001256 12/2008

OTHER PUBLICATIONS

L.A. Behrmann, J.L. Elbel, "Effect of perforations on fracture initiation," Journal of Petroleum Technology May 1991.

(Continued)

*Primary Examiner* — William P Neuder
*Assistant Examiner* — Ronald Runyan
(74) *Attorney, Agent, or Firm* — Mathieu Vandermolen; Rachel E. Greene; Tim Curington

(57) ABSTRACT

A method of fracturing multiple zones within a wellbore formed in a subterranean formation is carried out by forming flow-through passages in two or more zones within the wellbore that are spaced apart from each other along the length of a portion of the wellbore. The flow-through passages within each zone have different characteristics provided by orienting the flow-through passages in directions in each of the two or more zones relative to a selected direction to provide differences in fracture initiation pressures within each of the two or more zones. A fracturing fluid is introduced into the wellbore in a fracturing treatment. The fracturing fluid in the fracturing treatment is provided at a pressure that is above the fracture initiation pressure of one of the two or more zones to facilitate fracturing of said one of two or more zones while remaining below the fracture initiation pressure of any other non-fractured zones of the two or more zones. The process is repeated for at least one or more non-fractured zones of the two or more zones.

52 Claims, 4 Drawing Sheets

(56) References Cited

U.S. PATENT DOCUMENTS

| | | | |
|---|---|---|---|
| 5,318,123 | A | 6/1994 | Venditto et al. |
| 5,360,066 | A | 11/1994 | Venditto et al. |
| 5,443,119 | A | 8/1995 | Chambers |
| 5,964,289 | A | 10/1999 | Hill |
| 6,003,599 | A | 12/1999 | Huber et al. |
| 6,006,838 | A | 12/1999 | Whiteley et al. |
| 6,173,773 | B1 | 1/2001 | Almaguer et al. |
| 6,435,277 | B1 | 8/2002 | Qu et al. |
| 6,508,307 | B1 | 1/2003 | Almaguer |
| 6,543,538 | B2 | 4/2003 | Tolman et al. |
| 6,703,352 | B2 | 3/2004 | Dahayanaka et al. |
| 6,907,936 | B2 | 6/2005 | Fehr et al. |
| 7,017,664 | B2 | 3/2006 | Walker et al. |
| 7,051,812 | B2 | 5/2006 | McKee et al. |
| 7,066,265 | B2 | 6/2006 | Surjaatmadja |
| 7,108,067 | B2 | 9/2006 | Themig et al. |
| 7,225,869 | B2 | 6/2007 | Willett et al. |
| 7,343,975 | B2 | 3/2008 | Surjaatmadja et al. |
| 2004/0144539 | A1 | 7/2004 | Smith et al. |
| 2006/0196667 | A1 | 9/2006 | Alba et al. |
| 2008/0156498 | A1 | 7/2008 | Phi et al. |
| 2008/0210429 | A1 | 9/2008 | McMillin et al. |
| 2009/0166035 | A1 | 7/2009 | Almaguer |
| 2011/0048707 | A1 | 3/2011 | Kalman et al. |

OTHER PUBLICATIONS

International Search Report and Written Opinion for the equivalent PCT patent application No. PCT/US2012/048744 issued on Feb. 19, 2013.

Oilfield Review, Oct. 1994, pp. 37-47, "The Promise of Elastic Anisotropy".

Behrmann et al., "Effect of Perforations on Fracture Initiation," Journal of Petroleum Technology, May 1991.

Abass, et al., "Oriented Perforations—A Rock Mechanics View", SPE 28555, Sep. 25-28, 1994.

Cherny, et al., "2D modeling of hydraulic Fracture Initiating at a wellbore with or without microannulus", SPE 119352—SPE Hydraulic Fracturing Technology Conference, The Woodlands, Texas, 2009, 23 pages, Jan. 19-21, 2009.

Cramer, "Stimulating Unconventional Reservoirs: Lessons Learned, Successful Practices, Areas for Improvement", SPE 114172—SPE Unconventional Reservoirs Conference, Keystone, Colorado, 2008, 19 pages, Feb. 10-12, 2008.

De, et al., "Predicting Natural or Induced Fracture Azimuths From Shear-Wave Anisotropy", SPE 50993 —SPE Reservoir Evaluation & Engineering, Aug. 1998, pp. 311-318.

Harrison, "Diverting agents—history and application", SPE 3653—Journal of Petroleum Technology, vol. 24, No. 5, May 1972, pp. 593-598.

Hossain, et al., "A Comprehensive Monograph for Hydraulic Fracture Initiation from Deviated Wellbores under Arbitrary Stress Regimes", Spe 54360 - Spe Asia Pacific Oil and Gas Conference and Exhibition, Jakarta, Indonesia, 1999, 11 pages, Apr. 20-22 1999.

Ketter, et al., "A Field Study Optimizing Completion Strategies for Fracture Initiation in Barnett Shale Horizontal Wells", SPE 103232—SPE ATCE, Sep. 24-27, 2006.

Kirk, et al., "Nuts", Encyclopedia of Chemical Technology, Third Edition, Wiley-Interscience, vol. 16, 1981, pp. 248-273, Nov. 18, 1981.

Luke, et al., "Test Method to Optimize Acid-Soluble Cement for Unconventional Gas Completions", SPE 114759, Jun. 16-19, 2008.

Mcdaniel, "Halliburton, Gas or Oil Producer? Layered? Laminated?—Basic Guiding Principles We Should Understand for Effective Fracture Stimulation", SPE 118348, Oct. 11-15, 2008.

Sayers, et al., "Calibrating the Mechanical Properties and In-Situ Stresses Using Acoustic Radial Profiles", SPE Annual Technical Conference and Exhibition, California, Nov. 11-14, 2007, pp. 1-8.

Waters, et al., "Use of horizontal well image tools to optimize Barnett Shale reservoir exploitation", SPE 103202, Sep. 24-27, 2006.

* cited by examiner

FIGURE 4A
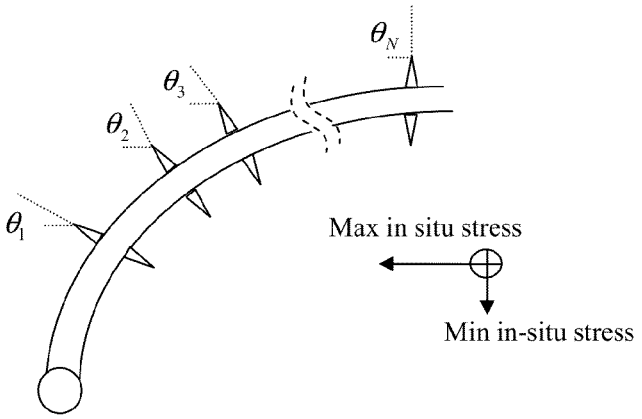
FIGURE 4B
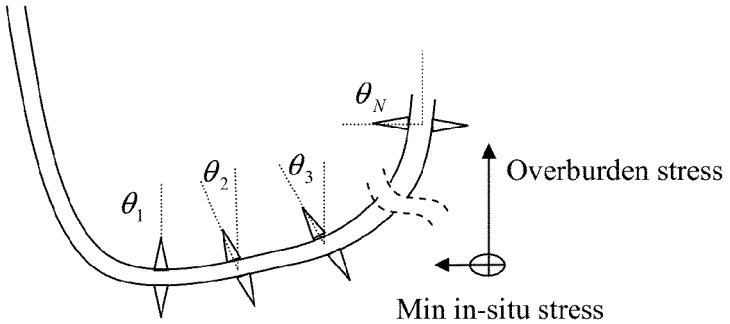
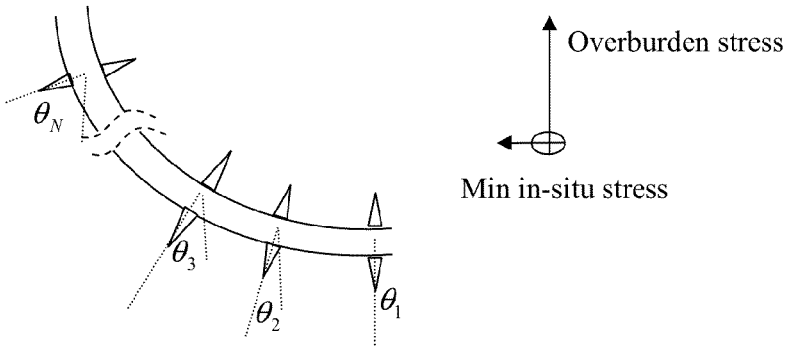
FIGURE 4C

METHOD OF FRACTURING MULTIPLE ZONES WITHIN A WELL

BACKGROUND

The statements in this section merely provide background information related to the present disclosure and may not constitute prior art.

Wellbore treatment methods often are used to increase hydrocarbon production by using a treatment fluid to affect a subterranean formation in a manner that increases oil or gas flow from the formation to the wellbore for removal to the surface. Major types of such treatments include fracturing operations, high-rate matrix treatments and acid fracturing, matrix acidizing and injection of chelating agents. Hydraulic fracturing involves injecting fluids into a subterranean formation at pressures sufficient to form fractures in the formation, with the fractures increasing flow from the formation to the wellbore. In chemical stimulation, flow capacity is improved by using chemicals to alter formation properties, such as increasing effective permeability by dissolving materials in or etching the subterranean formation. A wellbore may be an open hole or a cased hole where a metal pipe (casing) is placed into the drilled hole and often cemented in place. In a cased wellbore, the casing (and cement if present) typically is perforated in specified locations to allow hydrocarbon flow into the wellbore or to permit treatment fluids to flow from the wellbore to the formation.

To access hydrocarbon effectively and efficiently, it may be desirable to direct the treatment fluid to multiple target zones of interest in a subterranean formation. There may be target zones of interest within various subterranean formations or multiple layers within a particular formation that are preferred for treatment. In prior art methods of hydraulic fracturing treatments, multiple target zones were typically treated by treating one zone within the well at time. These methods usually involved multiple steps of running a perforating gun down the wellbore to the target zone, perforating the target zone, removing the perforating gun, treating the target zone with a hydraulic fracturing fluid, and then isolating the perforated target zone. This process is then subsequently repeated for all the target zones of interest until all the target zones are treated. As can be appreciated, such methods of treating multiple zones can be highly involved, time consuming and costly.

Accordingly, methods of treating multiple zones within a subterranean formation are desired that overcome these shortcomings.

SUMMARY

A method of fracturing multiple zones within a wellbore formed in a subterranean formation is accomplished by performing steps (a) through (d). In (a), flow-through passages are formed in two or more zones within the wellbore that are spaced apart from each other along the length of a portion of the wellbore. The flow-through passages within each zone according to (a) have different characteristics provided by orienting the flow-through passages in directions in each of the two or more zones relative to a selected direction to provide differences in fracture initiation pressures within each of the two or more zones.

In (b), a fracturing fluid is introduced into the wellbore in a fracturing treatment and in (c) a pressure of the fracturing fluid in the fracturing treatment is provided that is above the fracture initiation pressure of one of the two or more zones to facilitate fracturing of said one of the two or more zones. The pressure of the fracturing fluid in (c) is below the fracture initiation pressure of any other non-fractured zones of the two or more zones. Step (d) requires repeating (c) for at least one or more non-fractured zones of the two or more zones.

In certain embodiments, the selected direction is a direction of principal stress of the formation surrounding the wellbore. The selected direction may be aligned with or in a plane parallel to a direction of principal stress of the formation surrounding the wellbore. In certain embodiments, the selected direction is at least one of a horizontal maximum stress, a vertical stress and a fracture plane.

In some embodiments, a reactive fluid is injected into at least one zone before fracture initiation occurs in that zone to facilitate reducing fracture initiation pressure. The reactive fluid may be an acid. The wellbore may be cemented using a cement that is substantially acid soluble.

The flow-through passages in certain embodiments may be formed in each zone using 0° or approximately 180° phasing in each zone. The flow-through passages of each zone may also lie within a single plane or be located within 1 meter from a single plane. The flow-through passages may be formed by at least one of a perforating gun, by jetting and by forming holes in a casing of the wellbore. The different characteristics of the flow-through passages may be provided by inclination of the wellbore in certain instances.

The method may further include isolating a zone fractured according to (c) prior to (d). A degradable material may be used for isolating the fractured zone in various applications. The isolating may also be achieved by the use of at least one of mechanical tools, ball sealers, packers, bridge plugs, flow-through bridge plugs, sand plugs, fibers, particulate material, viscous fluid, foams, and combinations of these.

In certain embodiments, the two or more zones may be located in a portion of the wellbore that is substantially vertical. In other embodiments, the two or more zones are located in a portion of the wellbore that is curved. In some embodiments, the two or more zones are located in a portion of the wellbore that is deviated from vertical. In other embodiments the two or more zones may be located in a portion of the wellbore that is substantially horizontal. In still other embodiments, the two or more zones may be located in a portion of the wellbore that is inclined by at least 30° from vertical.

In some applications, the flow-through passages within each zone may have a minimal angle that is different by 5° or more from the minimum angle of flow passages of any other of the two or more zones. The flow-through passages within the fractured zone of (c) may also be oriented in certain instances at an angle relative to the selected direction that is less than the angle of the flow-through passages of any other non-fractured zones of the two or more zones. In some embodiments, a flow-through passage of the non-fractured zone of the two or more zones subsequently fractured according to (d) may be oriented at an angle relative to the selected direction that is at least 5° less than a flow-through passage of said one of the two or more zones fractured previously in (c). At least one of the flow-through passages within the zone fractured in (c) may be oriented at an angle relative to the selected direction in certain applications that is less than the angle of any flow-through passages relative to the selected direction in any other non-fractured zones of the two or more zones fractured according to (d).

The zone fractured according to (c) may be located towards a toe position of the wellbore and the zone fractured according to (d) may be located towards a heel position of the wellbore in certain embodiments. In other embodiments, the zone fractured according to step (c) may be located towards a heel position of the wellbore and the zone fractured according to step (d) may be located towards a toe position of the wellbore.

The fracturing fluid of the fracturing treatment may be selected from at least one of a hydraulic fracturing fluid, a reactive fracturing fluid and a slick-water fracturing fluid. The fracturing fluid may also contain at least one of proppant, fine particles, fibers, fluid loss additives, gelling agents and friction reducing agents in certain applications.

In certain embodiments, the fracturing may be carried out while being monitored.

Each zone may have from 1 to 10 flow-through-passage clusters in some embodiments. In certain instances, each flow-through-passage cluster may have a length of from 0.1 to 200 meters.

BRIEF DESCRIPTION OF THE DRAWINGS

For a more complete understanding of the present invention, and the advantages thereof, reference is now made to the following descriptions taken in conjunction with the accompanying figures, in which:

FIG. 4A is a schematic representation of a top view of a horizontal well with a curved trajectory showing perforations oriented at different angles ($\theta$) relative to maximum and minimum horizontal in-situ stresses;

FIG. 4B is a schematic representation of a side view of a deviated well with an almost vertical toe section showing perforations oriented at different angles ($\theta$) relative to maximum (overburden) and minimum in-situ stresses;

FIG. 4C is a schematic representation of a side view of a deviated wellbore showing perforations oriented at different angles ($\theta$) relative to maximum (overburden) and minimum in-situ stresses.

DETAILED DESCRIPTION

Figure 1A:
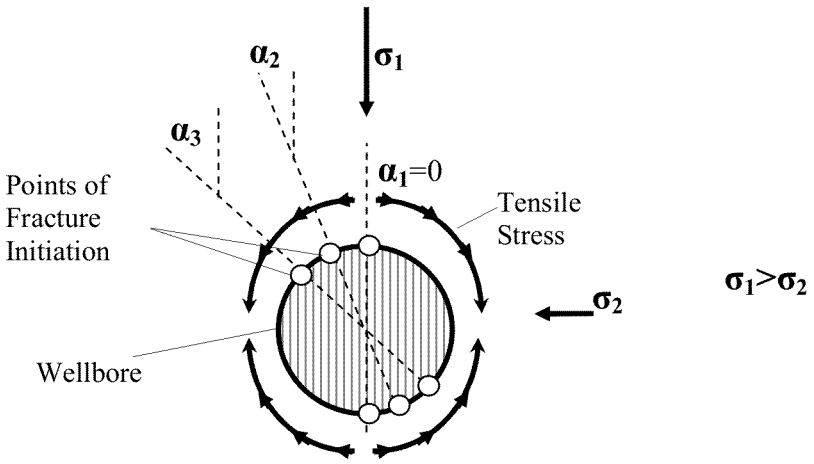
FIG. 1A is a schematic representation of a cross section of a wellbore showing different stresses surrounding the wellbore and the angle ($\alpha$) of perforations formed in the wellbore relative to these stresses.

The following description and examples are presented solely for the purpose of illustrating the different embodiments of the invention and should not be construed as a limitation to the scope and applicability of the invention. While any compositions of the present invention may be described herein as comprising certain materials, it should be understood that the composition could optionally comprise two or more chemically different materials. In addition, the composition can also comprise some components other than the ones already cited. While the invention may be described in terms of treatment of vertical or horizontal wells, it is equally applicable to wells of any orientation. The invention will be described for hydrocarbon production wells, but it is to be understood that the invention may be used for wells for production of other fluids, such as water or carbon dioxide, or, for example, for injection or storage wells. It should also be understood that throughout this specification, when a concentration or amount range is described as being useful, or suitable, or the like, it is intended that any and every concentration or amount within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 10" is to be read as indicating each and every possible number along the continuum between about 1 and about 10. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

The present invention is directed toward the creation of fractures in multiple zones of a subterranean formation during a fracturing treatment. The method may be used for cased and uncased (open hole) well sections. As described herein, the fracturing treatment is carried out as a single pumping operation and is distinguished from multiple fracturing treatments that may be used to treat different or multiple zones in a formation. As used herein, the expression "single pumping operation" is meant to encompass the situation where pumping of a fracturing fluid has commenced but no further perforation equipment (or other equipment) for forming openings in the wellbore or subjecting previously created openings to wellbore fluid is reintroduced into the wellbore or moved to another position to facilitate fracturing treatments after the fracturing fluid has been introduced. In the single pumping operation, pumping rates, pressures, and the character and makeup of the fluids pumped may be varied and the pumping may even be halted temporarily and resumed to perform the fracturing treatment. As used herein, this would still constitute a single pumping operation or fracturing treatment. Additionally, in certain applications, the single pumping operation may be conducted while the original perforation equipment is still present in the wellbore.

In the present invention, to accomplish the staged treating of several zones in a well during a single fracturing treatment or pumping operation, differences in fracture initiation pressures of different wellbore zones are utilized. The differences in fracture initiation pressures for the different zones are created by means of particular oriented flow-through passages formed in the wellbore. As used herein, the expression "flow-through passage(s)" or similar expressions is meant to encompass passages formed in the casing and/or wellbore. Commonly, the flow-through passages may be formed by perforating guns that are lowered into the wellbore and that perforate the casing and/or wellbore. As such, the flow-through passages may be referred to as "perforation(s)" and the expressions "flow-through passage(s)," "perforation(s)," "perforation channel(s)," "perforation tunnel(s)" and similar expressions may be used herein interchangeably unless expressly indicated or is otherwise apparent from its context. Additionally, while flow-through passages may be formed by employing a perforating gun, other methods of forming the flow-through passages may also be used. These may include jetting, cutting, sawing, drilling, filing and the like. In certain embodiments, the flow-through passages may be formed in the casing at the surface or outside of the wellbore, such as described in International Publication No. WO2009/001256A2, which is herein incorporated by reference in its entirety for all purposes. The flow-through passages may also have different sizes, shapes and configurations. Examples, of certain transverse cross-sectional shapes for the flow-through passages include circular, oval, rectangular, polygonal, half circles, slots, etc., and combinations of these and other shapes. In certain embodiments, the cross-sectional length or axis of greatest dimension may be oriented parallel or non-parallel to the longitudinal axis of the casing or wellbore. The diameter or transverse cross dimension of the flow-through passages or perforations may range from 2 to 40 mm. The flow-through passages may have a length of from 0.005 to 3 meters.

By orienting the flow-through passages or perforations in the different zones being treated so that the angles between the formed perforation channels in each zone and a selected direction, heterogeneity in fracture initiation pressure can be achieved. A fracturing fluid is then introduced into the wellbore at a pressure above the fracture initiation pressure of one of the perforated zones to facilitate fracturing of the zone. In the next stage of the fracturing treatment, the fracturing pressure is then increased above the fracturing pressure of the next perforated zone to facilitate fracturing of the next zone. This is repeated until all the zones have been fractured. In certain embodiments, isolating of the different zones between fracturing stages may be carried out.

The method may be utilized in the creation of multiple fractures within the same formation layer or in the creation of multiple fractures in a multi-layered formation, and can be applied to vertical, horizontal and deviated wells. The method may be combined with limited entry fracturing techniques to facilitate further diversion of fluids in several zones at a given injection rate. The method may also be combined with other existing fluid diverting and zonal isolation techniques well known to those skilled in the art.

Differences between the main principal stresses in a formation facilitate providing differences in the fracture initiation pressure around the wellbore. For instance in vertical wells, anisotropy between horizontal stresses causes formation of additional tensile stress in the near-wellbore zone. As used herein, vertical wells are those with less than a 30° deviation from vertical. The differences in the horizontal stresses in vertical wells results in the dependence of the fracture initiation pressure on a position of the fracture initiation point on the wellbore.

Figure 1B:
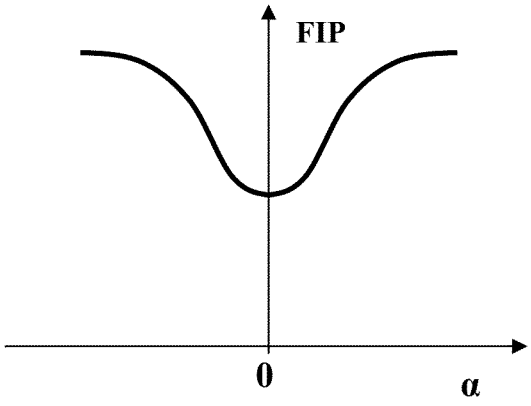
FIG. 1B is a plot of the angle ($\alpha$) of perforations relative to a direction of a maximum principal stress $\sigma_1$ in the plane perpendicular to the wellbore direction and the fracture initiation pressure (FIP)

To further illustrate this, reference is made to FIGS. 1A and 1B, which shows a transverse cross section of a wellbore with various stresses shown around the wellbore. In FIG. 1A, the fracture breakdown pressure is minimal when the perforation tunnel is aligned in the direction of maximum stress or in a plane that is parallel to the direction of the maximum stress (i.e. maximum stress=$\sigma_1$ in FIGS. 1A and 1B). The angle ($\alpha$) of deviation of the perforation tunnel from the direction of maximum stress causes an increase in the fracture initiation pressure (FIP), as illustrated in FIG. 1B.

Figure 2:
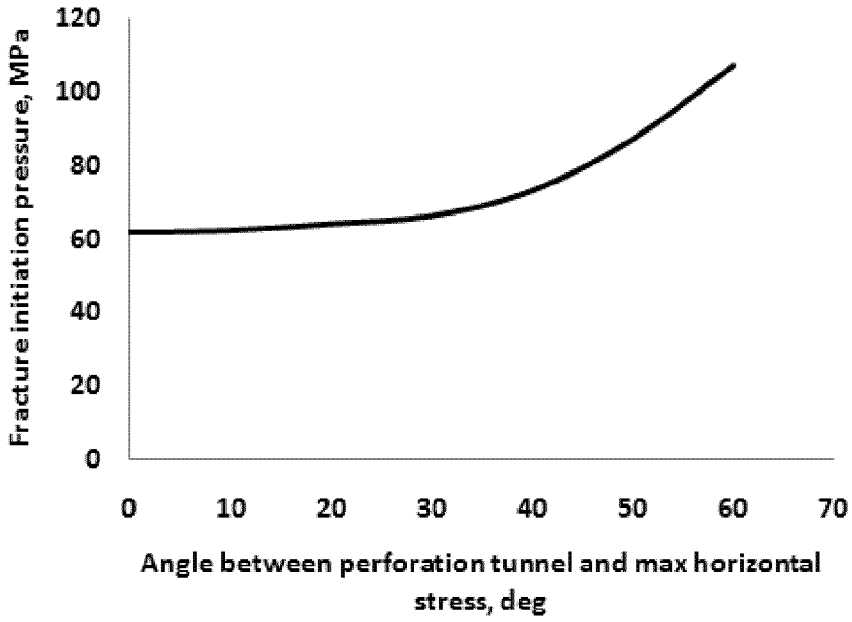
FIG. 2 is a plot of the angle between perforation tunnel of a wellbore and maximum horizontal stress in a vertical well and the fracture initiation pressure.

FIG. 2 further shows the numerically estimated dependences of the fracture initiation pressure in a vertical well on the angle between the perforation tunnel and the direction of the maximum horizontal stress. The magnitude of the calculated increase in the fracture initiation pressure caused by the deviation of the perforation tunnel was in good agreement with experimentally measured values. For purposes of computing the fracture initiation pressure, the model described in Cherny et al., "2D Modeling of Hydraulic Fracture Initiation at a Wellbore With or Without Microannulus," SPE 119352 (2009), which is herein incorporated by reference in its entirety, was used. Three near-wellbore layers were modeled: steel casing, cement and rock. In the calculations, the assumed length of the perforation tunnel was 0.5 m. The effect of the micro annulus was not accounted for and leak off was neglected. Rock properties were the following:

1. Young modulus=20.7 GPa
2. Minimum horizontal stress=69 MPa
3. Maximum horizontal stress=103.5 Mpa, which corresponds to stress anisotropy ratio equal to 1.5
4. Poisson's ratio=0.27

Geometry was the following:

1. Inner Casing Radius=4.9 cm
2. Outer Casing Radius=5.6 cm
3. Wellbore Hole Radius=7.8 cm.
4. Young Modulus of Casing=200 GPa
5. Young Modulus of Cement=8.28 GPa Similarly, in ideal horizontal wells (90 degree) the differences of pressures of fracture initiation from differently aligned perforation channels is created by the difference between the overburden stress and a combination of horizontal stresses ($\sigma_{horizontal\ min}$; $\sigma_{horizontal\ max}$). Such combination of horizontal stresses depends on the orientation of the lateral section in the formation and turns toward $\sigma_{horizontal\ min}$ and $\sigma_{horizontal\ max}$ when the horizontal section is drilled in the direction of the maximum and minimum horizontal stress, correspondingly. Typically, in horizontal wells, the overburden or vertical stress is the greatest stress (i.e. overburden stress=$\sigma_1$ in FIGS. 1A and 1B).

The tools and techniques for measuring stress anisotropy are well known in the art. The approaches and practical cases have been discussed, for instance, in Oilfield Review, October 1994, pp. 37-47, "The Promise of Elastic Anisotropy". Sonic logs in combination with other logs can identify anisotropic rocks (e.g., deep shale). The physics used for this kind of analysis is based on the phenomena that compression waves travel faster in the direction of applied stress. There are two requirements for anisotropy—alignment in preferential direction and the scale smaller than that of measurement (here—the wavelength). Thus, sonic anisotropy (heterogeneity in the rock) can be measured using ultrasound (small scale), sonic waves (mid scale) and seismic (large scale).

In the simplest cases, two types of alignment (horizontal and vertical) can be considered, which produce two types of anisotropy. In the simplest horizontal case, elastic properties vary vertically but not in layers. This type of rock is called transversely isotropic with the vertical axis of symmetry (TIV). The alternative case of horizontal axis of symmetry is TIH. Both cases of anisotropy may be determined with DSI Dipole Shear Sonic Imager™ tool, available from Schlumberger Technology Corp., Sugar Land, Tex. The DSI tool fires shear sonic pulses alternatively from two perpendicular transmitters to an array of similarly orientated receivers, and the pulse splits into polarization. At this scale of measurement (about borehole size) the most common evidence for TIV layering anisotropy comes from different P-waves velocities measured in vertical and highly deviated (or horizontal) wells. The same technique is applied for processing of S-waves (log presents Slow shear and Fast shear curves). Field examples of using information about velocity (elastic) anisotropy is presented in SPE 110098-MS (Calibrating the Mechanical Properties and In-Situ Stresses Using Acoustic Radial Profiles) and SPE 50993-PA (Predicting Natural or Induced Fracture Azimuths From Shear-Wave Anisotropy).

In deviated wellbores the effect of perforation orientation on fracture initiation pressure is more complex and depends on anisotropy between all three principal stresses. Predicting the fracture initiation pressure in this situation is still based on calculating the stress field around the wellbore in the perforated region, which also requires knowledge about the wellbore orientation in that zone. A comprehensive monograph for hydraulic fracture initiation from deviated wellbores under arbitrary stress regimes is presented in Hossain et al., SPE 54360 (1999), which is incorporated herein by reference. U.S. Pat. No. 4,938,286 discloses a method for hydraulic fracture simulating a formation penetrated by a horizontal wellbore. The horizontal wellbore is perforated on its top side. Then the formation is fractured through the said perforations with a fracturing fluid containing low-density proppant. Then perforations are sealed with perforation sealers to redirect fluid to the next interval. U.S. Pat. No. 5,360,066 discloses a method for controlling the flow of sand and other solids from a wellbore comprising the steps of a determining the direction of the maximum horizontal stress; and b. perforating the wellbore orienting perforations in the direction of the maximum horizontal stress. U.S. Pat. No. 5,318,123 discloses a method for optimizing hydraulic fracturing of a well comprising steps of a determining the direction of fracture propagation; b. perforating wellbore in the direction of fracture propagation; c. pumping fracturing fluid to propagate said fractures into said formation. Methods disclosed in the cited patents are substantially different from the proposed method of the present invention. To the best of author's knowledge using orienting perforations for sequential fracture treatment diversion between several wellbore zones have not been disclosed so far.

Differences in perforating angles in the various zones are selected to provide differences in fracture initiation pressures in the different zones to provide individual and sequential treatment of each zone. The method of establishing the angle of perforation to provide the desired fracture initiation pressure of the zone to be treated may include mathematical modeling, such as described in Cherny et al. (SPE 119352) and Hossain et al. (SPE 54360), discussed previously. Empirically derived data may also be used to determine the angle of perforation used in a particular treatment. In such instances, correlations between the fracture initiation pressure and angle of perforation may be determined by laboratory tests. Examples of such empirically derived methods include those that are described in Behrmann et al., "Effect of Perforations on Fracture Initiation," *Journal of Petroleum Technology*, (May 1991) and Abass et al., "Oriented Perforations—A Rock Mechanics View," SPE 28555 (1994), each of which is incorporated herein by reference in its entirety. In certain instances, specific knowledge of a particular formation obtained from experience in using oriented perforated systems in the formation may provide enough information to correlate the perforation angles with the desired fracture initiation pressures for particular zones in the same or a similar formation.

Once the principal stresses surrounding the wellbore are determined in the zone or zones to be treated, a perforating system can be configured to provide the proper flow-through passage orientation or perforation entry characteristics. This may be accomplished by using oriented perforating techniques. Such technology enables the perforating of the wellbore casing at selected angels toward one of the principal stresses. Various methods of orienting oriented perforating tools in wellbores are known. Orienting perforating charges in a wellbore may be achieved by mechanical rotary systems, by applying magnetic positioning devise (MPD) or by using gravity based methods. Suitable tools for perforating may include tubing conveyed perforating (TCP) guns that utilize orienting spacers, oriented jetting systems, mechanical tools for drilling or cutting casing walls, oriented laser systems, etc. Non-limiting examples of oriented perforating systems and methods include those described in U.S. Pat. Nos. 6,173,773 and 6,508,307 and U.S. Patent App. Pub. Nos. US2009/0166035 and US2004/0144539, each of which is incorporated herein by reference in its entirety. An example of a commercially available oriented perforating system is that available as OrientXact™ perforating system, from Schlumberger Technology Corporation, Sugar Land, Tex., which is a tubing conveyed oriented perforating system.

In the present invention, the perforating system provides near-wellbore flow-through passages or perforations. Such system may provide perforations that penetrate the formation about 3 meters, 2 meters, 1 meter or less. The perforations in each zone may utilize 0° or approximately 180° charge phasing. A cluster of perforations may be provided in each zone with substantially the same orientation and charge phasing or the perforations may oriented with a perforation angle of less than ±5° from one another within the same cluster. The flow-through passage(s) or perforation(s) that is oriented at an angle closest to the direction or plane that is parallel to the selected direction of a principal or maximum stress may be referred to as the "minimal angle" for that particular cluster or zone. There may be from 1 to 500 perforations provided in each cluster, more particularly from about 10 to 20. The length of each perforation cluster may range from about 0.1 to 200 meters, more particularly from about 0.5 to 5 meters. The distance between clusters may range from about 5 to 500 meters, more particularly from about 10 to 150 meters. Of course, the spacing, number of perforations, etc. will depend upon the individual characteristics of each well and the zones being treated.

The differences in the flow-through passage or perforation angles between each treated zone will typically vary at least ±5° or ±10° from zone to zone. The minimal angle of each zone may differ from the minimal angle of other zones by 5° or more. This difference in minimal angle may include the differences in minimal angles between one zone and the zone having the next highest fraction initiation pressure. Where the minimal angles of different zones differ by rotation of the minimal angle through a rotation of 360°, this would still constitute a difference of at 5° or more (i.e. minimal angle+360°) even though both flow-through passages of the different zones could have essentially the same orientation. In certain cases the differences in the angles from zone to zone may vary from ±15°, ±20°, ±25°, ±30° or more. The difference in perforation angles from zone to zone, however, may depend upon the formation type and formation stresses surrounding the wellbore that provide the desired differences in fracture initiation pressure. The differences in fracture initiation pressure, however, will depend on formation characteristics so that these pressures should not necessarily be construed to limit the invention. In certain instances where flow-through passage angles in each zone may range or vary within the zone, the flow-through passage angle(s) within the zone of the next highest fraction initiation pressure or that is fractured next may have a flow-through passage angle(s) relative to the direction or plane that is parallel to the direction of a principal or maximum stress that is at least 5° less than at least one flow-through passage of the zone having the next lowest fraction initiation pressure or that is previously fractured.

Typically, the perforations are oriented so that the perforated zone with the lowest fracture initiation pressure is in a toe or bottom position of the wellbore, with the remaining zones extending toward the heel position, so that the formation is treated toe to heel or from bottom to top of the wellbore. Of course, the perforated zones may be configured so that the lower fracture initiation pressure is located in the heel or top, with the fracturing treatment being carried out heel to toe or out of top to bottom of the well.

To carry out the multi-zone fracturing treatment in accordance with the invention, the bottomhole pressure during the treatment is controlled so that it is maintained below the fracture initiation pressure of each subsequent zone to be treated. This can be achieved by fracture initiation pressures represented by the Formula (I) below:

$$FIP_1<FIP_2<\ldots<FIP_{N-1}<FIP_N \quad (1)$$

where N is the total number of zones being treated in the fracturing operation. In the case of the first zone to be treated, the fracture initiation pressure $FIP_1$ is lower than the fracture initiation pressure in all the other zones to be fractured in the fracturing operation. Introducing fracturing fluids at pressures or rates so that the pressure is at or above $FIP_1$ but below the other fracture initiation pressures of the remaining zones (i.e. zones 2 to N) facilitates the multi-stage fracturing treatment. Likewise, in the second zone to be treated, the pressure is increased to at or above fracture initiation pressure $FIP_2$ of the second zone to be fractured. The fracturing initiation pressure for the second zone is less than the fracture initiation pressure of the remaining untreated zones (i.e. zones 3 to N). The fracturing initiation pressure is sequentially increased for each zone until all the zones have been sequentially fractured. In certain cases, the fractured zones may be isolated prior to increasing the fracture pressure to fracture the next zone to be fractured. Various isolation techniques may be employed that are well known in the art. This may include the use of various mechanical tools, ball sealers, diversion with particulate material, bridge plugs, flow-through bridge plugs, sand plugs, fibers, particulate material, diversion with viscous fluids and foams, etc., and combinations of these. In other cases, isolation of the different zones is not utilized.

In certain cases, fracture initiation pressure in some or all zones may be artificially lowered before fracturing the zones. Pumping acid or reactive chemicals for lowering fracture initiation pressure may be used, such as described in SPE 118348 and SPE 114172. Such methods may be used effectively even for substantially inert formations. Acid (e.g. HCl) may be particularly useful on wells completed with the use of acid soluble cement, such as described in SPE103232 and SPE114759.

Figure 3:
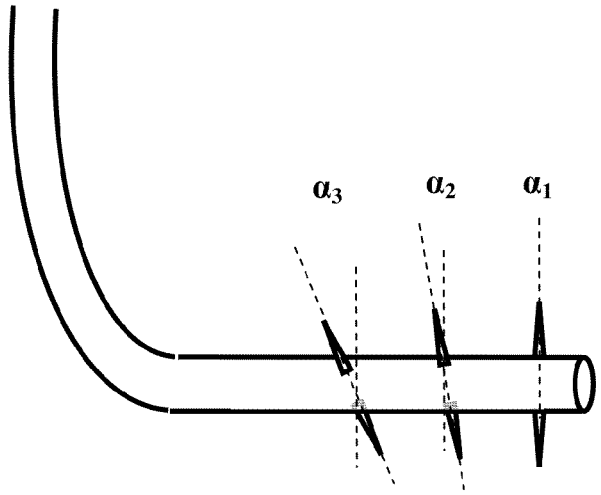
FIG. 3 is a schematic representation of a horizontal section of a cased well drilled showing various perforations oriented at different angles.

FIG. 3 shows a horizontal section of a cased well drilled in the direction of maximum horizontal stress in a homogeneous formation with a constant fracture gradient. In the first step, a few zones in the well are perforated using oriented perforating technology with approximately 180° charge phasing in each zone. The angle $\alpha$ between the perforation channels and the vertical direction or plane that includes the horizontal section of the wellbore is varied from zone to zone, as shown. In this case, the vertical direction represents the overburden or largest principal stress surrounding the wellbore. In the horizontal well section of FIG. 3, the angle $\alpha_1$ in the toe section of the well is minimal so that the fracture initiation pressure in this zone is at the lowest level. The angle $\alpha$ then is gradually increased toward the heel. According to FIGS. 1A and 1B, the fracture initiation pressure is thus gradually increased along the wellbore to the different perforated zones.

Further fracturing in the horizontal well section of FIG. 3 is performed in stages. The first stage is designed to stimulate the toe or most distant wellbore zone with minimal fracture initiation pressure. Pressure during this treatment is maintained at a level below the fracture initiation pressure in the next zone. After stimulation of the first zone may be isolated, such as with ball sealers, while fluid is continuously introduced without stopping. This results in a pressure increase in the wellbore and initiating of a fracture in the zone located next to the previously treated zone. Further repetition of the described steps enables the selective stimulation of all perforated intervals during one treatment cycle.

FIGS. 4A-4C illustrate other examples of perforation orientations for multistage fracturing treatments in wells with curved trajectories in horizontal or vertical planes. The multiple zones may be located in a long interval located in one productive layer. The perforation of the interval may be accomplished in one run by the use of a perforating gun, such as oriented tubing-conveyed perforating (TCP) system that may consist of several charge tubes in one carrier. FIG. 4A shows one horizontal deviated well with a curved trajectory. FIG. 4B shows a deviated well with a curved vertical trajectory. FIG. 4C shows a well with a deviated trajectory. Several perforation clusters may be formed within each of the intervals shown and each interval is fractured in turn. The perforations in each cluster may be oriented at 180° phasing with the perforations in each cluster being at different angles $\theta_1 \ldots \theta_N$ to the maximum in-situ stress. In FIGS. 4A-4C, there are noticeable differences between the vertical and horizontal stresses, as shown.

In each case of the embodiments of FIGS. 4A-4C, the orientation of the perforations in the created geometry will result in the controlled varying of the fracture initiation pressure from zone to zone. In each case, the fracturing treatment consists of N treatment stages with a possible N−1 isolating stages in between the fracturing of each zone. In the first treatment stage, a fracturing fluid is pumped into the wellbore and the zone with the minimal fracture initiation pressure is fracture stimulated. The fracturing fluid pressure must be maintained below that of the next lowest fracturing initiation pressure for the remaining unfractured zones. Isolating may be carried out to isolate the fractured zone using known isolating techniques, such as ball sealers, bridge plugs, sand plugs, particulates, fibers, etc. After isolating, pumping is resumed or continued and the next zone with the next lowest fracture initiation pressure is fractured. This zone may also then be isolated. This process is repeated until all zones are subsequently fractured.

Figure 5:
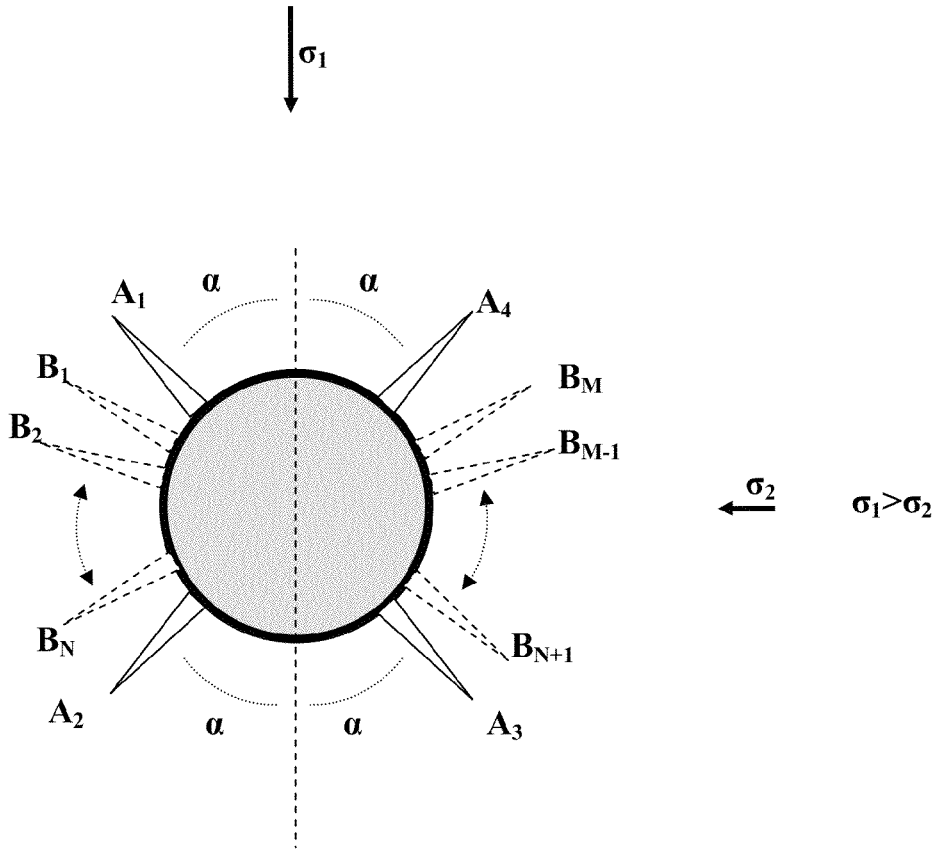
FIG. 5 is a schematic representation of a cross section of a wellbore showing an example of a perforation strategy that enables treatment diversion from a zone to zone, with perforations $A_1$, $A_2$, $A_3$ and $A_4$ being misaligned from the direction of the maximum stress or plane that includes the direction of the maximum stress on some angle ($\alpha$) and perforations $B_1$, $B_2$, . . . $B_N$, . . . $B_M$ being misaligned from the direction of the maximum stress at a larger angle.

FIG. 5 shows an example of an alternative perforation strategy that may be used for creating heterogeneity in fracture initiation pressure in wellbore zones. In this example each zone has perforations of two types namely primary: $A_i$ (i=1 . . . 4), and secondary: $B_i$·(j=0 . . . M), having different orientations in relation to maximum stress. Here primary perforations $A_1$, $A_2$, $A_3$ and $A_4$ are misaligned from the direction of the maximum stress on some angle ($\alpha$) and perforations $B_1, B_2, \ldots B_N, \ldots B_M$ are misaligned from the direction of the maximum stress at a larger angle. In one embodiment of the present invention each wellbore zone may have at least one perforation of type $A_i$ and one or more perforations of type $B_i$. With such perforations, orientation fracture initiation pressure in the perforated zone will depend on angle $\alpha$ and will not depend on orientation of secondary perforations ($B_i$). Changing angle $\alpha$ in a set of perforations in different wellbore zones will enable different fracture initiation pressure in those zones.

The fracturing of the different zones may be conducted while being monitored. Various methods to confirm and identify those zones that are actually being treated in the multistage treatment can be used. For instance, analysis of bottomhole pressure data may be used wherein the level of bottomhole pressure is compared to the created distribution of fracture initiation pressure in the perforated intervals. The analysis of the bottomhole pressure profile may also facilitate an understanding of the created fracture geometry. Real-time microseismic diagnostics can be used wherein microseismic events generated during fracturing are registered to provide an understanding of the position and geometry of the fractured zone. This method is well known in the art and is widely used in the oil and gas industry. Real-time temperature logging can also be used. Such methods use distributed temperature sensing that indicates which portion of a wellbore is being treated. Such methods are well known to those skilled in the art and may utilize fiber optics for measuring the temperature profile during treatment. Real-time radioactive logging may be used. This method relies on positioning a radioactive sensor in the wellbore before running a treatment and detecting a signal from radioactive tracers added in the treatment fluid during the job. Analyzing low frequency pressure waves (tubewaves) generated and propagated in the wellbore can also be used. The pressure waves are reflected from fractures, obstacles in the wellbore, completion segments, etc. The decay rates and resonant frequencies of free and forced pressure oscillations are used to determine characteristic impedance and the depth of each reflection in the well, after removing resonances caused by known reflectors.

The multistage fracturing can be used in different formation fracturing treatments. These include hydraulic fracturing with use of propping agents, hydraulic fracturing without use of propping agents, slick-water fracturing and reactive fracturing fluids (e.g. acid and chelating agents). The fracturing fluids and systems used for carrying out the fracturing treatments are typically aqueous fluids. The aqueous fluids used in the treatment fluid may be fresh water, sea water, salt solutions or brines (e.g. 1-2 wt. % KCl), etc. Oil-based or emulsion based fluids may also be used.

In hydraulic fracturing, the aqueous fluids are typically viscosified so that they have sufficient viscosities to carry or suspend proppant materials, increase fracture width, prevent fluid leak off, etc. In order to provide the higher viscosity to the aqueous fracturing fluids, water soluble or hydratable polymers are often added to the fluid. These polymers may include, but are not limited to, guar gums, high-molecular weight polysaccharides composed of mannose and galactose sugars, or guar derivatives such as hydropropyl guar (HPG), carboxymethyl guar (CMG), and carboxymethylhydroxypropyl guar (CMHPG). Cellulose derivatives such as hydroxyethylcellulose (HEC) or hydroxypropylcellulose (HPC) and carboxymethylhydroxyethylcellulose (CMHEC) may also be used. Any useful polymer may be used in either crosslinked form, or without crosslinker in linear form. Xanthan, diutan, and scleroglucan, three biopolymers, have been shown to be useful as viscosifying agents. Synthetic polymers such as, but not limited to, polyacrylamide and polyacrylate polymers and copolymers are used typically for high-temperature applications. Fluids incorporating the polymer may have any suitable viscosity sufficient for carrying out the treatment. Typically, the polymer-containing fluid will have a viscosity value of from about 50 mPa·s or greater at a shear rate of about 100 $s^{-1}$ at treatment temperature, more typically from about 75 mPa·s or greater at a shear rate of about 100 $s^{-1}$, and even more typically from about 100 mPa·s or greater at a shear rate of about 100 $s^{-1}$.

In some embodiments of the invention, a viscoelastic surfactant (VES) is used as the viscosifying agent for the aqueous fluids. The VES may be selected from the group consisting of cationic, anionic, zwitterionic, amphoteric, nonionic and combinations thereof. Some nonlimiting examples are those cited in U.S. Pat. Nos. 6,435,277 and 6,703,352, each of which is incorporated herein by reference. The viscoelastic surfactants, when used alone or in combination, are capable of forming micelles that form a structure in an aqueous environment that contribute to the increased viscosity of the fluid (also referred to as "viscosifying micelles"). These fluids are normally prepared by mixing in appropriate amounts of VES suitable to achieve the desired viscosity. The viscosity of VES fluids may be attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior. Fluids incorporating VES based viscosifiers may have any suitable viscosity for carrying out the treatment. Typically, the VES-containing fluid will have a viscosity value of from about 50 mPa·s or greater at a shear rate of about 100 $s^{-1}$ at treatment temperature, more typically from about 75 mPa·s or greater at a shear rate of about 100 $s^{-1}$, and even more typically from about 100 MPa·s or greater at a shear rate of about 100 $s^{-1}$.

The fluids may also contain a gas component. The gas component may be provided from any suitable gas that forms an energized fluid or foam when introduced into the aqueous medium. See, for example, U.S. Pat. No. 3,937,283 (Blauer et al.), hereinafter incorporated by reference. The gas component may comprise a gas selected from nitrogen, air, argon, carbon dioxide, and any mixtures thereof. Particularly useful are the gas components of nitrogen or carbon dioxide, in any quality readily available. The fluid may contain from about 10% to about 90% volume gas component based upon total fluid volume percent, more particularly from about 20% to about 80% volume gas component based upon total fluid volume percent, and more particularly from about 30% to about 70% volume gas component based upon total fluid volume percent. It should be noted that volume percent presented herein for such gases is based on downhole conditions where downhole pressures impact the gas phase volume.

In slick-water fracturing, which is typically used in low-permeable or "tight" gas-containing formations, such as tight-shale or sand formations, the fluid is a low viscosity fluid (e.g. 1-50 mPa·s), typically water. This may be combined with a friction reducing agent. Typically, polyacrylamides or guar gum are used as the friction-reducing agent. In such treatments, lighter weight and significantly lower amounts of proppant (e.g. 0.012 kg/L to 0.5 kg/L or 1.5 kg/L) than in conventional viscosified fracturing fluids may be used. The proppant used may have a smaller particle size (e.g. 0.05 mm to 1.5 mm, more typically 0.05 mm to 1 mm) than those used from conventional fracturing treatments used in oil-bearing formations. Where it is used, the proppant may have a size, amount and density so that it is efficiently carried, dispersed and positioned by the treatment fluid within the formed fractures.

In hydraulic fracturing applications, an initial pad fluid that contains no proppant may be initially introduced into the wellbore to initiate the fractures in each zone. This is typically followed by a proppant-containing fluid to facilitate propping of the fractured zone once it is fractured. The proppant particles used may be those that are substantially insoluble in the fluids of the formation. Proppant particles carried by the treatment fluid remain in the fracture created, thus propping open the fracture when the fracturing pressure is released and the well is put into production. Any proppant (gravel) can be used, provided that it is compatible with the base and any bridging-promoting materials if the latter are used, the formation, the fluid, and the desired results of the treatment. Such proppants (gravels) can be natural or synthetic, coated, or contain chemicals; more than one can be used sequentially or in mixtures of different sizes or different materials. Proppants and gravels in the same or different wells or treatments can be the same material and/or the same size as one another and the term "proppant" is intended to include gravel in this discussion. Proppant is selected based on the rock strength, injection pressures, types of injection fluids, or even completion design. The proppant materials may include, but are not limited to, sand, sintered bauxite, glass beads, mica, ceramic materials, naturally occurring materials, or similar materials. Mixtures of proppants can be used as well. Naturally occurring materials may be underived and/or unprocessed naturally occurring materials, as well as materials based on naturally occurring materials that have been processed and/or derived. Suitable examples of naturally occurring particulate materials for use as proppants include, but are not necessarily limited to: ground or crushed shells of nuts such as walnut, coconut, pecan, almond, ivory nut, brazil nut, etc.; ground or crushed seed shells (including fruit pits) of seeds of fruits such as plum, olive, peach, cherry, apricot, etc.; ground or crushed seed shells of other plants such as maize (e.g., corn cobs or corn kernels), etc.; processed wood materials such as those derived from woods such as oak, hickory, walnut, poplar, mahogany, etc., including such woods that have been processed by grinding, chipping, or other form of size degradation, processing, etc. Further information on some of the above-noted compositions thereof may be found in Encyclopedia of Chemical Technology, Edited by Raymond E. Kirk and Donald F. Othmer, Third Edition, John Wiley & Sons, Volume 16, pages 248-273 (entitled "Nuts"), Copyright 1981, which is incorporated herein by reference. In general the proppant used will have an average particle size of from about 0.05 mm to about 5 mm, more particularly, but not limited to typical size ranges of about 0.25-0.43 mm, 0.43-0.85 mm, 0.85-1.18 mm, 1.18-1.70 mm, and 1.70-2.36 mm. Normally the proppant will be present in the carrier fluid in a concentration of from about 0.12 kg proppant added to each liter of carrier fluid to about 3 kg proppant added to each L of carrier fluid, preferably from about 0.12 kg proppant added to each liter of carrier fluid to about 1.5 kg proppant added to each liter of carrier fluid.

Other particulate materials may also be used, such as for bridging materials, proppant carrying agents or leak-off control agents. These may include degradable materials that are intended to degrade after the fracturing treatment. Degradable particulate materials may include those materials that can be softened, dissolved, reacted or otherwise made to degrade within the well fluids to facilitate their removal. Such materials may be soluble in aqueous fluids or in hydrocarbon fluids. Oil-degradable particulate materials may be used that degrade in the produced fluids. Non-limiting examples of degradable materials may include, without limitation, polyvinyl alcohol, polyethylene terephthalate (PET), polyethylene, dissolvable salts, polysaccharides, waxes, benzoic acid, naphthalene based materials, magnesium oxide, sodium bicarbonate, calcium carbonate, sodium chloride, calcium chloride, ammonium sulfate, soluble resins, and the like, and combinations of these. Particulate material that degrades when mixed with a separate agent that is introduced into the well so that it mixes with and degrades the particulate material may also be used. Degradable particulate materials may also include those that are formed from solid-acid precursor materials. These materials may include polylactic acid (PLA), polyglycolic acid (PGA), carboxylic acid, lactide, glycolide, copolymers of PLA or PGA, and the like, and combinations of these.

In many applications, fibers are used as the particulate material, either alone or in combination with other non-fiber particulate materials. The fibers may be degradable as well and be formed from similar degradable materials as those described previously. Examples of fibrous materials include, but are not necessarily limited to, natural organic fibers, comminuted plant materials, synthetic polymer fibers (by non-limiting example polyester, polyaramide, polyamide, novoloid or a novoloid-type polymer), fibrillated synthetic organic fibers, ceramic fibers, inorganic fibers, metal fibers, metal filaments, carbon fibers, glass fibers, ceramic fibers, natural polymer fibers, and any mixtures thereof. Particularly useful fibers are polyester fibers coated to be highly hydrophilic, such as, but not limited to, DACRON® polyethylene terephthalate (PET) fibers available from Invista Corp., Wichita, Kans., USA, 67220. Other examples of useful fibers include, but are not limited to, polylactic acid polyester fibers, polyglycolic acid polyester fibers, polyvinyl alcohol fibers, and the like.

The thickened or viscosified fluids described, with or without a gas component, may also be used in acid fracturing applications, as well, wherein multiple zones are treated in accordance with the invention. As used herein, acid fracturing may include those fracturing techniques wherein the treatment fluid contains a formation-dissolving material. In such treatments, alternate reactive fluids (aqueous acids, chelants etc) with non-reactive fluids (VES-fluids, polymer-based fluids) may be used during the acid fracturing operations. In carbonate formations, the acid is typically hydrochloric acid, although other acids may be used. In such treatments, the fluids are injected at a pressure above the fracture initiation pressure of the particular zone of a carbonate (e.g. limestone and dolomite) formation being treated. In acid fracturing a proppant may not be used because the acid causes differential etching in the fractured formation to create flow paths for formation fluids to flow to the wellbore so that propping of the fracture is not necessary.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method of fracturing multiple zones within a wellbore formed in a subterranean formation, the method comprising:

(a) forming flow-through passages in two or more zones within the wellbore that are spaced apart from each other along the length of a portion of the wellbore, the flow-through in each of the two or more passages orientated relative to a selected direction to provide different fracture initiation pressures within each of the two or more zones;

(b) introducing a fracturing fluid into the wellbore in a fracturing treatment;

(c) providing a pressure of the fracturing fluid in the fracturing treatment that is above the fracture initiation pressure of one of the two or more zones to facilitate fracturing of said one of the two or more zones, the pressure of the fracturing fluid being below the fracture initiation pressure of any other non-fractured zones of the two or more zones; and then (d) repeating (c) for at least one or more non-fractured zones of the two or more zones.

2. The method of claim 1, wherein the selected direction is a direction of a principal stress of the formation surrounding the wellbore.

3. The method of claim 1, wherein the selected direction is aligned with or in a plane parallel to a direction of a principal stress of the formation surrounding the wellbore.

4. The method of claim 1, wherein a reactive fluid is injected into at least one zone before fracture initiation occurs in that zone to facilitate reducing fracture initiation pressure.

5. The method of claim 1, wherein the flow-through passages are formed by at least one of a perforating gun, by jetting and by forming holes in a casing of the wellbore.

6. The method of claim 1, further comprising isolating at least one previously fractured zone formed in (c) prior to (d).

7. The method of claim 1, wherein the flow-through passages within each zone has a minimal angle that is different by 5° or more from the minimum angle of flow passages of any other of the two or more zones.

8. The method of claim 7, wherein a degradable material is used for isolating the fractured zone.

9. The method of claim 7, wherein isolating is achieved by the use of at least one of mechanical tools, ball sealers, packers, bridge plugs, flow-through bridge plugs, sand plugs, fibers, particulate material, viscous fluid, foams, and combinations of these.

10. The method of claim 1, wherein the zone fractured according to step (c) is located towards a toe position of the wellbore and the zone fractured according to step (d) is located towards a heel position of the wellbore.

11. The method of claim 1, wherein the zone fractured according to step (a) is located towards a heel position of the wellbore and the zone fractured according to step (c) is located towards a toe position of the wellbore.

12. The method of claim 1, wherein the fracturing fluid is selected from at least one of a hydraulic fracturing fluid, a reactive fracturing fluid and a slick-water fracturing fluid.

13. The method of claim 1, wherein the fracturing fluid contains at least one of proppant, fine particles, fibers, fluid loss additives, gelling agents and friction reducing agents.

14. The method of claim 1, wherein the selected direction is at least one of a horizontal maximum stress, a vertical stress and a fracture plane.

15. The method of claim 1, wherein the fracturing is carried out while being monitored.

16. A method of fracturing multiple zones within a wellbore formed in a subterranean formation, the method comprising:

(a) forming flow-through passages in two or more zones within the wellbore that are spaced apart from each other along the length of a portion of the wellbore, the flow-through passages within each zone having different characteristics provided by orienting the flow-through passages in different directions in each of the zones relative to the principal stress of the formation surrounding the wellbore, the flow-through passages within each zone having a minimal angle relative to the selected direction that is different by 5° or more from the minimum angle of flow passages relative to the selected direction of any other of the two or more zones;

(b) introducing a fracturing fluid into the wellbore in a fracturing treatment;

(c) providing a pressure of the fracturing fluid in the fracturing treatment that is above the fracture initiation pressure of one of the two or more zones to facilitate fracturing of said one of the two or more zones, the pressure of the fracturing fluid being below the fracture initiation pressure of any other non-fractured zones of the two or more zones; and then (d) repeating step (c) for at least one or more non-fractured zone of the two or more zones.

17. The method of claim 16, wherein a reactive fluid is injected into at least one zone before fracture initiation occurs in that zone to facilitate reducing fracture initiation pressure.

18. The method of claim 17, wherein the reactive fluid is an acid.

19. The method of claim 16, wherein the wellbore is cemented using a cement that is substantially acid soluble.

20. The method of claim 16, wherein the flow-through passages are formed in each zone using 0° or approximately 180° phasing in each zone.

21. The method of claim 16, wherein the flow-through passages are formed by at least one of a perforating gun, by jetting and by forming holes in a casing of the wellbore.

22. The method of claim 16, further comprising isolating at least one previously fractured zone formed in (c) prior to proceeding to (d).

23. The method of claim 22, wherein a degradable material is used for isolating the fractured zone.

24. The method of claim 22, wherein isolating is achieved by the use of at least one of mechanical tools, ball sealers, packers, bridge plugs, flow-through bridge plugs, sand plugs, fibers, particulate material, viscous fluid, foams, and combinations of these.

25. The method of claim 16, wherein the two or more zones are located in a portion of the wellbore that is substantially vertical.

26. The method of claim 16, wherein the two or more zones are located in a portion of the wellbore that is curved.

27. A method of fracturing multiple zones within a wellbore formed in a subterranean formation, the method comprising:

(a) forming flow-through passages in two or more zones within the wellbore that are spaced apart from each other along the length of a portion of the wellbore, the flow-through passages within each zone having different characteristics provided by orienting the flow-through passages in different directions in each of the zones relative to a selected direction, the flow-through passages within each zone having a minimal angle relative to the selected direction that is greater by 5° or more from the minimum angle of flow passages relative to the selected direction of any other of the two or more zones;

(b) introducing a fracturing fluid into the wellbore in a fracturing treatment;

(c) providing a pressure of the fracturing fluid in the fracturing treatment that is above the fracture initiation pressure of one of the two or more zones to facilitate fracturing of said one of the two or more zones, the pressure of the fracturing fluid being below the fracture initiation pressure of any other non-fractured zones of the two or more zones;

(d) repeating step (c) for one or more non-fractured zone of the two or more zones; and (e) isolating at least one zone fractured according to (c) prior to (d).

28. The method of claim 27, wherein the selected direction is a direction of a principal stress of the formation surrounding the wellbore.

29. The method of claim 27, wherein the selected direction is aligned with or in a plane parallel to a direction of a principal stress of the formation surrounding the wellbore.

30. The method of claim 27, wherein a reactive fluid is injected into at least one zone before fracture initiation occurs in that zone to facilitate reducing fracture initiation pressure.

31. The method of claim 30, wherein the reactive fluid is an acid.

32. The method of claim 27, wherein the wellbore is cemented using a cement that is substantially acid soluble.

33. The method of claim 27, wherein the flow-through passages are formed in each zone using 0° or approximately 180° phasing in each zone.

34. The method of claim 27, wherein the flow-through passages are formed by at least one of a perforating gun, by jetting and by forming holes in a casing of the wellbore.

35. The method of claim 27, wherein a degradable material is used for isolating the at least one zone fractured according to (c).

36. The method of claim 27, wherein isolating is achieved by the use of at least one of mechanical tools, ball sealers, packers, bridge plugs, flow-through bridge plugs, sand plugs, fibers, particulate material, viscous fluid, foams, and combinations of these.

37. The method of claim 27, wherein the two or more zones are located in a portion of the wellbore that is substantially vertical.

38. The method of claim 27, wherein the two or more zones are located in a portion of the wellbore that is curved.

39. The method of claim 27, wherein the two or more zones are located in a portion of the wellbore that is inclined by at least 30° from vertical.

40. The method of claim 27, wherein the two or more zones are located in a portion of the wellbore that is substantially horizontal.

41. The method of claim 27, wherein the flow-through passages within the fractured zone of (c) are oriented at an angle relative to the selected direction that is less than the angle of the flow-through passages of any other non-fractured zones of the two or more zones.

42. The method of claim 27, wherein a flow-through passage of the non-fractured zone of the two or more zones subsequently fractured according to (d) is oriented at an angle relative to the selected direction that is at least 5° less than a flow-through passage of one of the two or more zones fractured previously in (c).

43. The method of claim 27, wherein at least one of the flow-through passages within the zone fractured in (c) is oriented at an angle relative to the selected direction that is less than the angle of any flow-through passages relative to the selected direction in any other non-fractured zones of the two or more zones fractured in (d).

44. The method of claim 27, wherein the zone fractured according to (c) is located towards a toe position of the wellbore and the zone fractured according to (d) is located towards a heel position of the wellbore.

45. The method of claim 27, wherein the zone fractured according to (c) is located towards a heel position of the wellbore and the zone fractured according to (d) is located towards a toe position of the wellbore.

46. The method of claim 27, wherein the fracturing fluid is selected from at least one of a hydraulic fracturing fluid, a reactive fracturing fluid and a slick-water fracturing fluid.

47. The method of claim 27, wherein the fracturing fluid contains at least one of proppant, fine particles, fibers, fluid loss additives, gelling agents and friction reducing agents.

48. The method of claim 27, wherein the selected direction is a direction of principal maximum stress of the formation surrounding the portion of the wellbore.

49. The method of claim 27, wherein the different characteristics of the flow-through passages is provided by inclination of the wellbore.

50. The method of claim 27, wherein each zone has from 1 to 10 flow-through-passage clusters.

51. The method of claim 50, wherein each flow-through-passage cluster has a length of from 0.1 to 200 meters.

52. The method of claim 27, wherein the fracturing is carried out while being monitored.

* * * * *